United States Patent [19]

Kordes

[11] Patent Number: 4,564,973

[45] Date of Patent: Jan. 21, 1986

[54] DOOR CLOSING DEVICE HAVING AN ADJUSTABLE LENGTH ARM

[75] Inventor: Herbert Kordes, Ennepetal, Fed. Rep. of Germany

[73] Assignee: Dorma-Baubeschlag GmbH & Co. KG., Ennepetal, Fed. Rep. of Germany

[21] Appl. No.: 545,732

[22] Filed: Oct. 24, 1983

[30] Foreign Application Priority Data

Oct. 22, 1982 [DE] Fed. Rep. of Germany ..... 3239062

[51] Int. Cl.[4] ..... E05F 1/00

[52] U.S. Cl. ..... 16/71; 16/49; 16/237; 16/DIG. 39; 403/104

[58] Field of Search ..... 16/235, 236, 237, 249, 16/49, 50, 71, 115, DIG. 39; 403/104, 106, 107

[56] References Cited

U.S. PATENT DOCUMENTS

| | | | |
|---|---|---|---|
| 2,782,453 | 2/1957 | Schlage | 16/49 |
| 2,960,718 | 11/1960 | Lasier | 16/49 |
| 3,710,645 | 1/1973 | Bennett | 403/107 X |
| 4,102,005 | 7/1978 | Schnarr et al. | 16/71 X |

*Primary Examiner*—Fred Silverberg

*Attorney, Agent, or Firm*—Michael J. Striker

[57] ABSTRACT

In a door closing device for an upper lock a bar structure is provided for interconnecting a shaft of the door upper lock with a door wing. The bar structure includes a main arm and an adjusting arm pivotally connected to the adjusting arm. The adjusting arm is comprised of telescopically displaceable outer and inner bars which can be locked in position by a locking member. The locked position of the bars relative to each other is secured by a slidable tube surrounding the outer bar and securable to the inner bar.

6 Claims, 4 Drawing Figures

DOOR CLOSING DEVICE HAVING AN ADJUSTABLE LENGTH ARM

BACKGROUND OF THE INVENTION

The present invention relates to devices arranged on the doors for automatic closing of the door. More particularly, the invention relates to a bar structure for the device for automatic closing the door.

In conventional devices of the type under consideration adjusting bar arrangements are utilized for a connection between the shaft of the upper door lock and the door wing or door frame, these arrangements including a main arm and an adjusting arm pivotally connected to the main arm, the adjusting arm having a receiving bar and an adjusting bar adjustably connected to the receiving bar.

The bar structure devices for door locks are adjustable within a wide range so that they can be utilized in various situations and adjusted to various slipping depths and various joint dislocations which result from various width of the doors.

It has been known that for adjusting the bar structure of a door lock, the adjusting bar of the adjusting arm was formed with an outer thread whereas the receiving bar was provided with the inner thread. In order to adjust the adjusting arm to a required position it was necessary that the bar structure of the adjusting arm together with the hinge had to be separated from the door wing or door frame and then the adjusting arm had to be displaced relative to the receiving arm. The described operation was time-consuming.

In other known constructions of the bar structures of the door locks, the adjusting bar and receiving bar were allowed to be displaced one relative to another, but in these constructions each bar was provided with a row of openings for receiving bolts which connected the both bars in any selected position. The disadvantage of these constructions is that, on the one hand, a plurality openings required for locking the bars in position substantially weakened the structure, and, on the other hand, the adjusting process was time consuming because the connecting bolts should be totally released and removed from the openings in order to adjust the position of the adjusting bar relative to the outer receiving bar.

SUMMARY OF THE INVENTION

It is an object of the invention to provide an improved adjusting device for a door lock.

It is still another object of the invention to provide a door lock adjusting device which can be easily adjusted to any required length without dismantling of the component parts of the device.

It is a further object ot the invention to provide a door lock adjusting device which is not costly and which is easy to operate.

These and other objects of the invention are attained by a door closing device for connecting a lock shaft of a door upper lock with a door wing or door frame, comprising a main arm and an adjusting arm pivotally connected to each other, said adjusting arm including an outer receiving bar and an inner adjusting bar adjustably connected to said outer bar, said outer bar and said inner bar being telescopically displaceable one relative to another, a releasable locking member for connecting said outer bar and said inner bar in any desired locked position, and a displaceable securing member for securing said inner and outer bars in said locked position.

Due to the fact that the locking member can be easily released the adjusting or inner bar is displaced relative to the outer bar to any desired position without dismantling of the hinge joint of the adjusting bar. Special tools for a required adjustment of the length of the door closing device are no longer needed.

According to another concept of the invention the inner bar may be formed with a first toothing extending lengthwise thereof, said outer being formed with a cutout and having two side walls, at least one of said side walls being formed with a second toothing extending lengthwise in the region of said cutout said first toothing corresponding to said second toothing and disposed next to the same, said locking member being disposed in said cutout and having a third toothing engageable with the first and second toothings. Thereby a form-locking connection between the outer bar and inner bar is provided.

The device according to the invention further includes hinge means for pivotally connecting said adjusting arm to said main arm, said hinge means including a hinge head connected to the inner bar, said securing member being a slidable tube surrounding and partially overlapping the outer bar and inner bar and being securable in position with respect to the hinge head. The slidable securing member, which may be locked in position, secures a lock between the inner bar and the outer bar.

According to a still further feature of the invention the slidable tube has an end facing towards said hinge head and is provided at said end with two tongues which form a projection therebetween which extends inwardly of the slidable tube, the hinge head being formed with a recess in which said projection is engageable. Due to this construction an unintended release of the slidable tube covering the outer and inner bars from the locked position is prevented and the whole device has a nice and compact appearance due to the covering of all component parts with the slidable tube.

Although normally the inner and outer bars are of cylindrical cross-section, it is a further feature of the present invention that the outer bar is a tube of rectangular cross-section and formed with said cutout by free cutting, both side walls of the outer bar being formed in the region of said cutout with said second toothing corresponding to said first toothing, the locking member having a width corresponding to the width of a narrower side of the outer bar, said third toothing corresponding to the first and second toothing and extending over the width of the locking member. The substitution of the round bar structure by the rectangular bar structure is advantageous for the connection of the adjusting arm to the hinge joint for fastening to a door wing or door frame and for forming the hinge head connectable to the main arm.

According to a still further feature of the invention the locking member may have a pivoting projection, said side walls of the outer bar being formed in the region of said cutout and next to the second toothing with recesses, said pivoting projection being engaged in those recesses. Due to this structure the projection of the locking member, after it has been released, still remains within the slidable tube whereas the locking member can be easily swung away from the engagement with the first and second toothing or into that engagement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
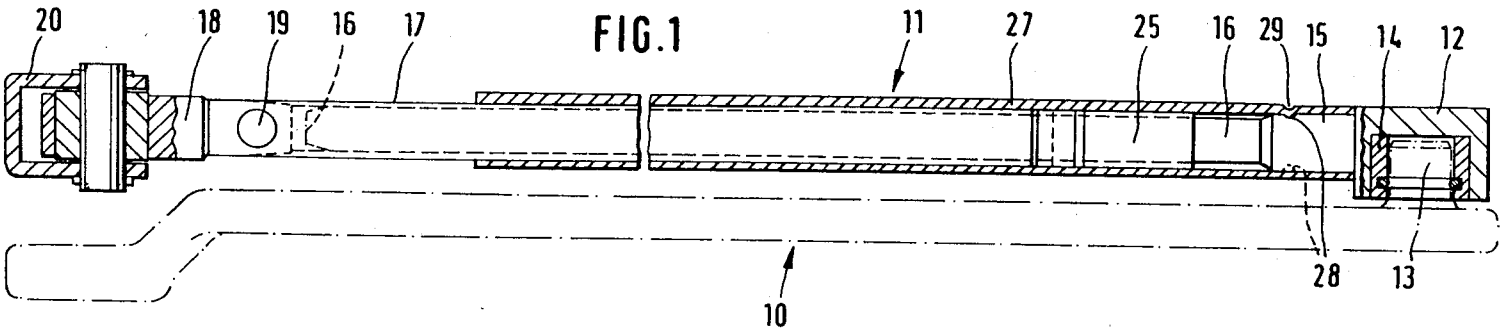
FIG. 1 is a side view, partially in section, of a door lock bars structure illustrating an adjusting bar and a receiving bar of an adjusting arm, shifted towards each other.
Figure 2:
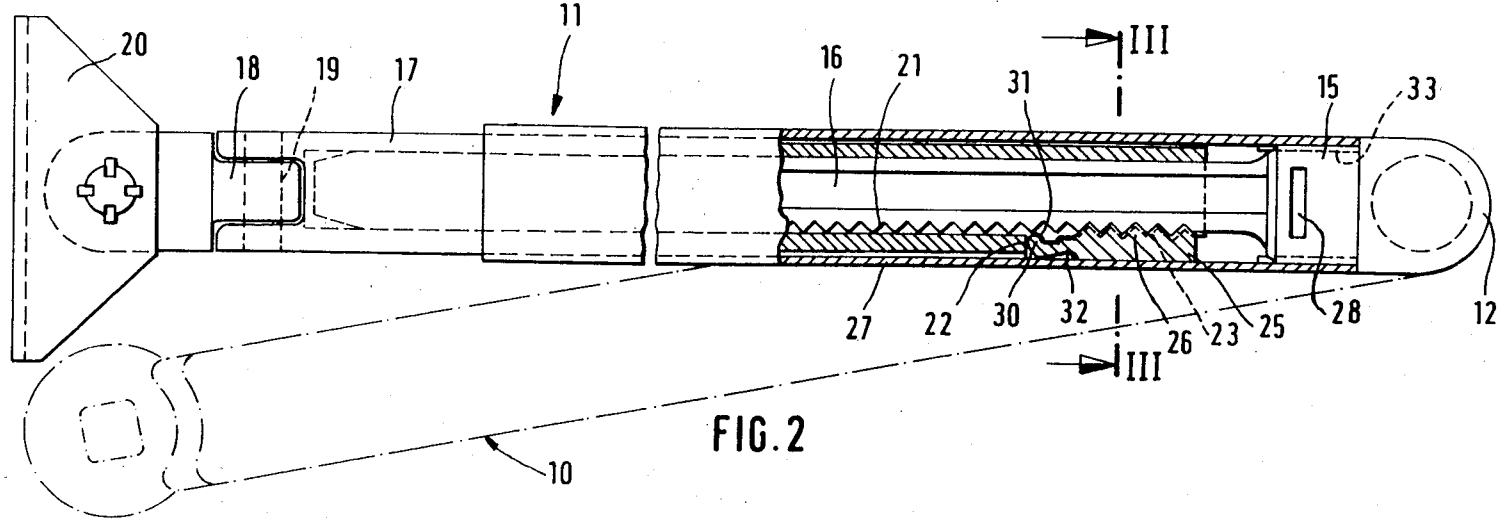
FIG. 2 is a top plan view, partially in section, of FIG. 1.

Referring now to the drawings, the door upper lock-bar structure comprises a main arm 10, which is shown in FIGS. 1 and 2 by a broken line, and an adjusting arm 11 shown by a solid line. Arms 10 and 11 are pivotally connected to each other by means of a hinge including a hinge head 12 mounted to the adjusting arm, pin 13 extended from the main arm 10 and an intermediate bearing sleeve 14 arranged within hinge head 12 and supporting pin 13.

Adjusting arm 11 is comprised of an inner adjusting bar 16 and an outer receiving bar 17 telescopically embracing adjusting bar 16. The hinge head 12 is a stable part of an adjusting bar 16 which has in the joint with hinge head 12 an extension 15 of rectangular cross-section to which the adjusting bar 16 is attached. The latter has a double-T cross-section as seen in the sectional view of FIG. 3.

The adjusting bar 16 is closely surrounded by the receiving bar 17 of rectangular cross-section. The receiving bar has at the end thereof facing from the hinge head 12, a fork-like end portion which is pivotally connected to a hinge joint 18 by a pin or pivot 19. A connection shoe 20 for connecting the bars structure to a door wing or a door frame, for example by screws, is pivotally supported on the hinge joint 18.

Figure 3:
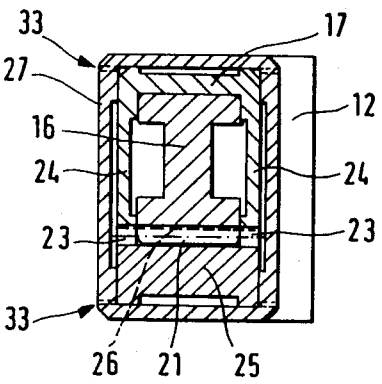
FIG. 3 is a sectional view on line III—III of FIG. 2.
Figure 4:
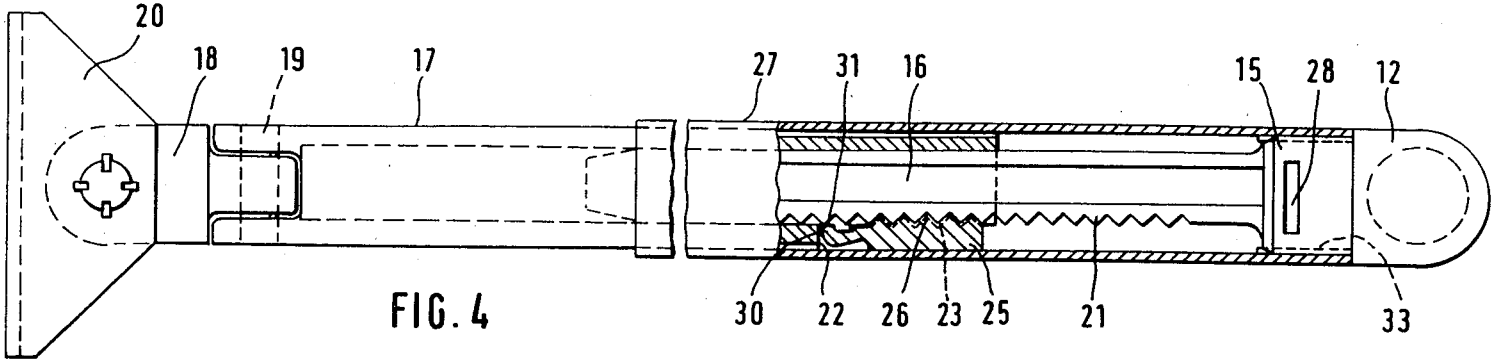
FIG. 4 is top plan view, partially in section, of the adjusting arm, illustrating the adjusting bar in the position in which it is partially pulled away from the receiving bar.

The adjusting bar 16 has on its narrower side a toothing with teeth 21 extending along the entire length of adjusting bar 16. The receiving or outer bar 17 in turn is formed with a cutout 22 made in two parallel narrower sides of bar 17 and extending in the direction of elongation of bar 17. This cutout is formed in the lengthwise direction so that toothings with teeth 23 on both opposite side walls 24 of the outer bar 17 are provided. The shape, the size and the direction of tips teeth 21 and 23 are the same so that in a corresponding position of the adjusting bar 16 in the lengthwise direction toothings 21 and 23 can be placed one after another as shown in FIG. 3. A locking member 25 is inserted in the cutout 22, which extends substantially over the entire width of the cutout. Locking member 25 is, on the side thereof facing towards the adjusting bar 16 and side walls 24 of bar 17, provided with teeth 26 which in shape and size conform to the teeth 21 and 23. The width of locking member 25 corresponds to the width of the outer bar 17 embracing adjusting bar 16 so that in the engaged poistion of the locking member teeth 26 engage with teeth 21 of the adjusting bar and teeth 23 formed on side walls 24 of the outer bar 17. In this engaged or locked position of bars 16 and 17, the adjusting bar 16 is locked relative to the outer bar 17 and the distance between hinge head 12 and connection shoe 20 is adjusted. For securing this locked position, a sliding tube 27 is provided, which surrounds outer bar 17. Sliding tube 27 holds locking member 25 in engagement with bars 16 and 17.

As best seen in FIGS. 1 and 2, the sliding tube 27 is somewhat shorter than the distance between connection shoe 20 and hinge head 12 when the bars 16 and 17 are in the position in which they are moved toward each other, but the sliding tube 27 can be moved backwardly so that the lock between locking member 25 and bars 16 and 17 can be released as will be explained in detail hereinafter. In order to prevent an unintentional displacement of sliding tube 27 relative to bar 17, a recess 28 is formed in each one of two opposite walls (upper or lower) of the extension 15 of the adjusting bar 16. The sliding tube 27 is formed with two supporting tongues 33 formed as elastic tongues and within those tongues inwardly extended projections 29 are provided. Each projection 29 can be engaged in the respective recess 28.

In order to hold the locking member during the adjustment of adjusting bar 16 relative to the outer bar 17 of the adjusting arm 11, the locking member 25 is provided in the area of teeth 26 with a pivoting bead or projection 30. This pivoting bead is engaged in semicircular recesses 31 formed in the side walls 24 of outer bar 17 in the region of cutout 22. For releasing the locking member 25 from the locked position the sliding tube 27 is now displaced in the backward direction unless the locking member can be swung or pivoted away from engagement with teeth 21 and 23, however the sliding tube 27 always encloses the locking member 25 in the region of pivoting bead 30. Thereby the pivoting movement of the locking member is possible. The pivoting of bead or projection 30 within the tube 27 is also possible due to the provision of a groove 32 formed in the outer wall of the locking member 25.

In order to shorten or lengthen the adjusting arm 11, it is necessary first to release the sliding tube 27, which operates as a securing member, by releasing projections 29 from respective recesses 28 and then to move the sliding tube 27 away from hinge head 12 so far as to enable the locking member to swing away from its engaged position with bars 16 and 17 but to permit the pivoting projection 30 to retain in recesses 31. The adjusting bar 16 formed as a spur rack can then be displaced back or forth relative to bar 17 and again form-lockingly connected with the tube-shaped outer bar 17 in any desired position so that the length of the arm 11 will be adjusted. Thereafter the sliding tube 27 is again moved towards the hinge head 12 unless the projections 29 on the inner walls of tube 27 are locked in recess 28 of extension 15 of adjusting bar 16. Thereby the adjusted position between inner bar 16 and outer bar 17 is secured and the whole adjusting unit is covered with tube 27 thereby providing a very nice appearance of the adjusting arm 11.

As has been mentioned above, any other embodiments of the invention are possible. It is conceivable, for example, to utilize the bars 16 and 17 of a circular or an annular cross-section in place of rectangular cross-section. The circular or annular bars could be provided with recesses for engaging with toothings or with a flat thread or the like. It is also possible to use instead of the locking member provided with teeth, a clamping cone by which bar 16 would be clamped in bar 17 in any desired position.

It will be understood that each of the elements described above, or two or more together, may also find a useful application in other types of door closing devices differing from the types described above.

While the invention has been illustrated and described as embodied in a door closing device of a door upper lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A door closing device for connecting a lock shaft of a door upper lock with a door wing or door frame, comprising a main arm and an adjusting arm pivotally connected to each other said adjusting arm including an outer receiving bar and an inner adjusting bar adjustably connected to said outer bar, each other, bar and said inner bar being telescopically displaceable one relative to another, a releasable locking member for connecting said outer bar and said inner bar in any desired locked position, and a securing member for securing said inner and outer bars in said locked position, said inner bar being formed with a first toothing extending lengthwise thereof, said outer bar being formed with a cutout and having two side walls, at least one of said side walls being formed with a second toothing extending lengthwise in the region of said cutout, said first toothing corresponding to said second toothing and disposed next to the same, said locking member being disposed in said cutout and having a third toothing engageable with said first and second toothing.

2. The device as defined in claim 1, further including hinge means for pivotally connecting said adjusting arm to said main arm, said hinge means including a hinge head connected to said inner bar, said securing member being a slidable tube surrounding and partially overlapping said outer bar and inner bar, said slidable tube being displaceable over said outer bar and securable in position with respect to said hinge head.

3. The device as defined in claim 2, wherein said slidable tube has an end facing towards said hinge head and is provided at said end with two tongues which form a projection therebetween which extends inwardly of the sliding tube, said hinge head being formed with a recess in which said projection is engageable.

4. The device as defined in claim 3, wherein said outer bar is a tube of rectangular cross-section and formed with said cutout, both side walls of said outer bar being formed in the region of said cutout with said second toothing corresponding to said first toothing, said locking member having a width corresponding to the width of a narrower side of said outer bar, said third toothing corresponding to said first and second toothing and extending over the width of said locking member.

5. The device as defined in claim 4, wherein said locking member has a pivoting projection, said side walls of the outer bar being formed in the region of said cutout and next to said second toothing with recesses, said pivoting projection being engaged in said recesses.

6. The device as defined in claim 5, wherein said inner tube has a double T-cross section.

* * * * *